US006634366B1

(12) United States Patent
Simmons et al.

(10) Patent No.: US 6,634,366 B1
(45) Date of Patent: Oct. 21, 2003

(54) HAIR PIECE ASSEMBLY

(76) Inventors: Christine M. Simmons, 4572 W. 4025 South, West Valley City, UT (US) 84120; Jolie De Vries, 1578 Duffys La., West Jordan, UT (US) 84084

( * ) Notice: Subject to any disclaimer, the term of this patent is extended or adjusted under 35 U.S.C. 154(b) by 16 days.

(21) Appl. No.: 10/036,874

(22) Filed: Jan. 4, 2002

(51) Int. Cl.[7] ..... A41G 3/00
(52) U.S. Cl. ..... 132/53; 132/278
(58) Field of Search ..... 132/201, 53, 54, 132/55, 56, 277, 278, 275; D28/39, 40, 41, 42, 43, 92, 93

(56) References Cited

U.S. PATENT DOCUMENTS

| | | | | | |
|---|---|---|---|---|---|
| 1,526,440 | A | | 2/1925 | Skaruda | |
| 1,714,358 | A | | 5/1929 | Finkelstein | |
| 2,165,716 | A | * | 7/1939 | Molleson | 132/53 |
| 2,561,310 | A | * | 9/1951 | Selson | 132/53 |
| 2,818,871 | A | * | 1/1958 | Beaudry | 132/277 |
| 3,385,305 | A | | 5/1968 | Buzzelli | |
| 3,412,739 | A | * | 11/1968 | Thatcher | 132/277 |
| 3,735,765 | A | * | 5/1973 | Ichelson | 132/277 |
| 4,830,029 | A | * | 5/1989 | Bird | 132/54 |
| D356,398 | S | | 3/1995 | Hafid | |
| D376,444 | S | | 12/1996 | Buckwalter | |
| 5,647,384 | A | | 7/1997 | Haber et al. | |
| 6,019,107 | A | * | 2/2000 | Overmyer et al. | 132/53 |
| 6,386,205 | B2 | * | 5/2002 | Sartena | 132/53 |
| 6,446,638 | B1 | * | 9/2002 | Horman | 132/275 |

* cited by examiner

*Primary Examiner*—Todd E. Manahan

(57) ABSTRACT

A hair piece assembly for allowing a user to prevent hairstyles from going flat during high humidity or wet weather. The hair piece assembly includes a clip assembly that is adapted for securing to the hair of the user such that the clip assembly is secured to the hair of the user. A plurality of filler hairs is coupled the clip assembly. The filler hairs are adapted for being combed into the hair of the user for providing volume to the hair of the user.

4 Claims, 4 Drawing Sheets

HAIR PIECE ASSEMBLY

BACKGROUND OF THE INVENTION

1. Field of the Invention

The present invention relates to hairpieces and more particularly pertains to a new hair piece assembly for allowing a user to prevent hairstyles from going flat during high humidity or wet weather.

2. Description of the Prior Art

The use of hairpieces is known in the prior art. More specifically hairpieces heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,385,305; U.S. Pat. No. 5,647,384; U.S. Pat. No. 1,714,358; U.S. Pat. No. 1,526,440; U.S. Pat. No. Des. 376,444; and U.S. Pat. No. Des. 356,398.

While these devices fulfill their respective, particular objectives and requirements, the aforementioned patents do not disclose a new hair piece assembly. The inventive device includes a clip assembly that is adapted for securing to the hair of the user such that the clip assembly is secured to the hair of the user. A plurality of filler hairs is coupled the clip assembly. The filler hairs are adapted for being combed into the hair of the user for providing volume to the hair of the user.

In these respects, the hair piece assembly according to the present invention substantially departs from the conventional concepts and designs of the prior art, and in so doing provides an apparatus primarily developed for the purpose of allowing a user to prevent hair styles from going flat during high humidity or wet weather.

SUMMARY OF THE INVENTION

In view of the foregoing disadvantages inherent in the known types of hair pieces now present in the prior art, the present invention provides a new hair piece assembly construction wherein the same can be utilized for allowing a user to prevent hair styles from going flat during high humidity or wet weather.

The general purpose of the present invention, which will be described subsequently in greater detail, is to provide a new hair piece assembly apparatus and method which has many of the advantages of the hair pieces mentioned heretofore and many novel features that result in a new hair piece assembly which is not anticipated, rendered obvious, suggested, or even implied by any of the prior art hair pieces, either alone or in any combination thereof.

To attain this, the present invention generally comprises a clip assembly that is adapted for securing to the hair of the user such that the clip assembly is secured to the hair of the user. A plurality of filler hairs is coupled the clip assembly. The filler hairs are adapted for being combed into the hair of the user for providing volume to the hair of the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application which is measured by the claims, nor is it intended to be limiting as to the scope of the invention in any way.

It is therefore an object of the present invention to provide a new hair piece assembly apparatus and method which has many of the advantages of the hair pieces mentioned heretofore and many novel features that result in a new hair piece assembly which is not anticipated, rendered obvious, suggested, or even implied by any of the prior art hair pieces, either alone or in any combination thereof.

It is another object of the present invention to provide a new hair piece assembly, which may be easily and efficiently manufactured and marketed.

It is a further object of the present invention to provide a new hair piece assembly, which is of a durable and reliable construction.

An even further object of the present invention is to provide a new hair piece assembly which is susceptible of a low cost of manufacture with regard to both materials and labor, and which accordingly is then susceptible of low prices of sale to the consuming public, thereby making such hair piece assembly economically available to the buying public.

Still yet another object of the present invention is to provide a new hair piece assembly, which provides in the apparatuses and methods of the prior art some of the advantages thereof, while simultaneously overcoming some of the disadvantages normally associated therewith.

Still another object of the present invention is to provide a new hair piece assembly for allowing a user to prevent hairstyles from going flat during high humidity or wet weather.

Yet another object of the present invention is to provide a new hair piece assembly, which includes a clip assembly that is adapted for securing to the hair of the user such that the clip assembly is secured to the hair of the user. A plurality of filler hairs is coupled the clip assembly. The filler hairs are adapted for being combed into the hair of the user for providing volume to the hair of the user.

Still yet another object of the present invention is to provide a new hair piece assembly that would benefit users who generally have flat hair and need a boost on a regular basis.

Even still another object of the present invention is to provide a new hair piece assembly that is easy to use as well as portable. The present invention a user could style hair in numerous ways for an attractive and contemporary look every time.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
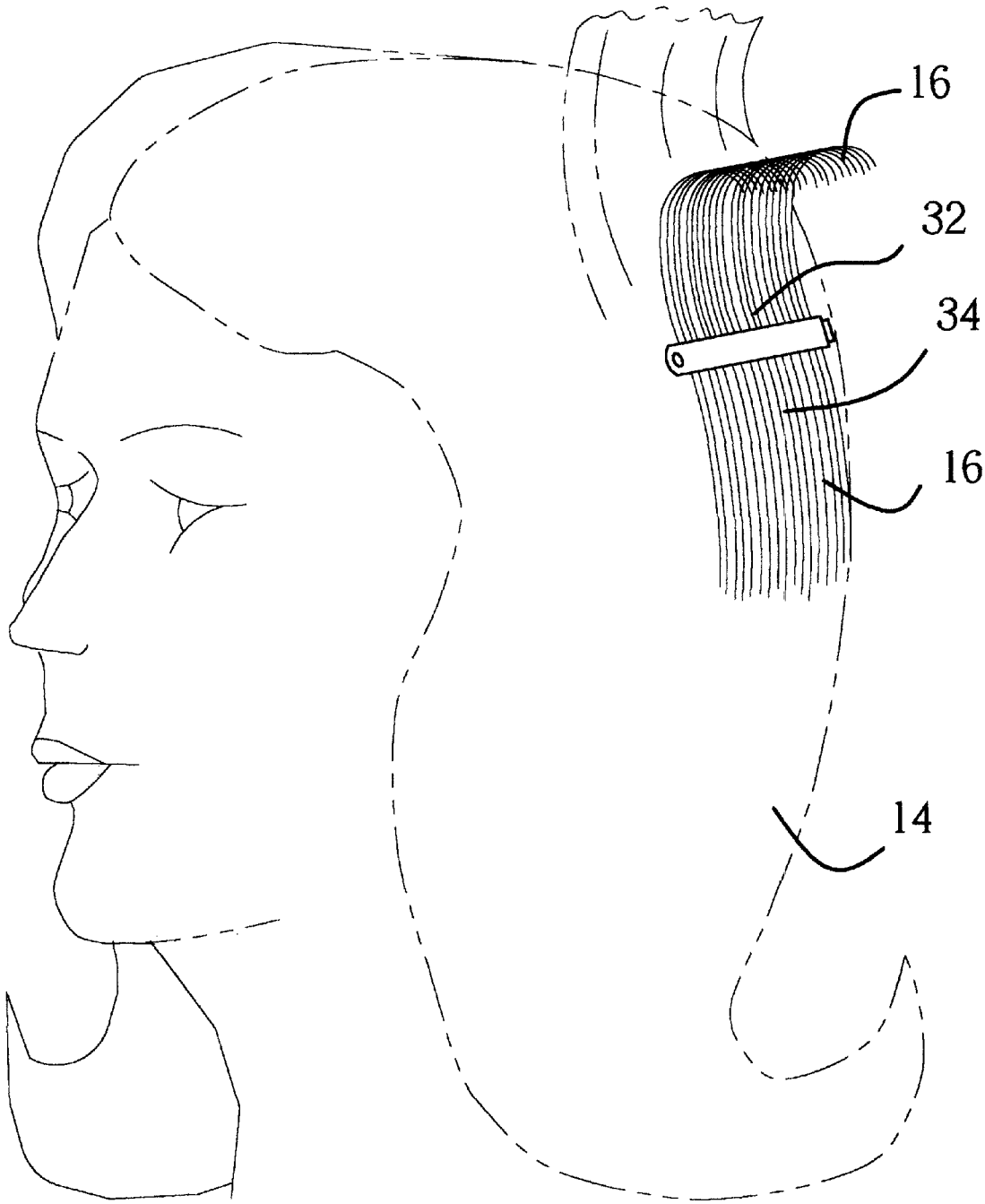
FIG. 1 is a perspective view of a new hair piece assembly according to the present invention.
Figure 2:
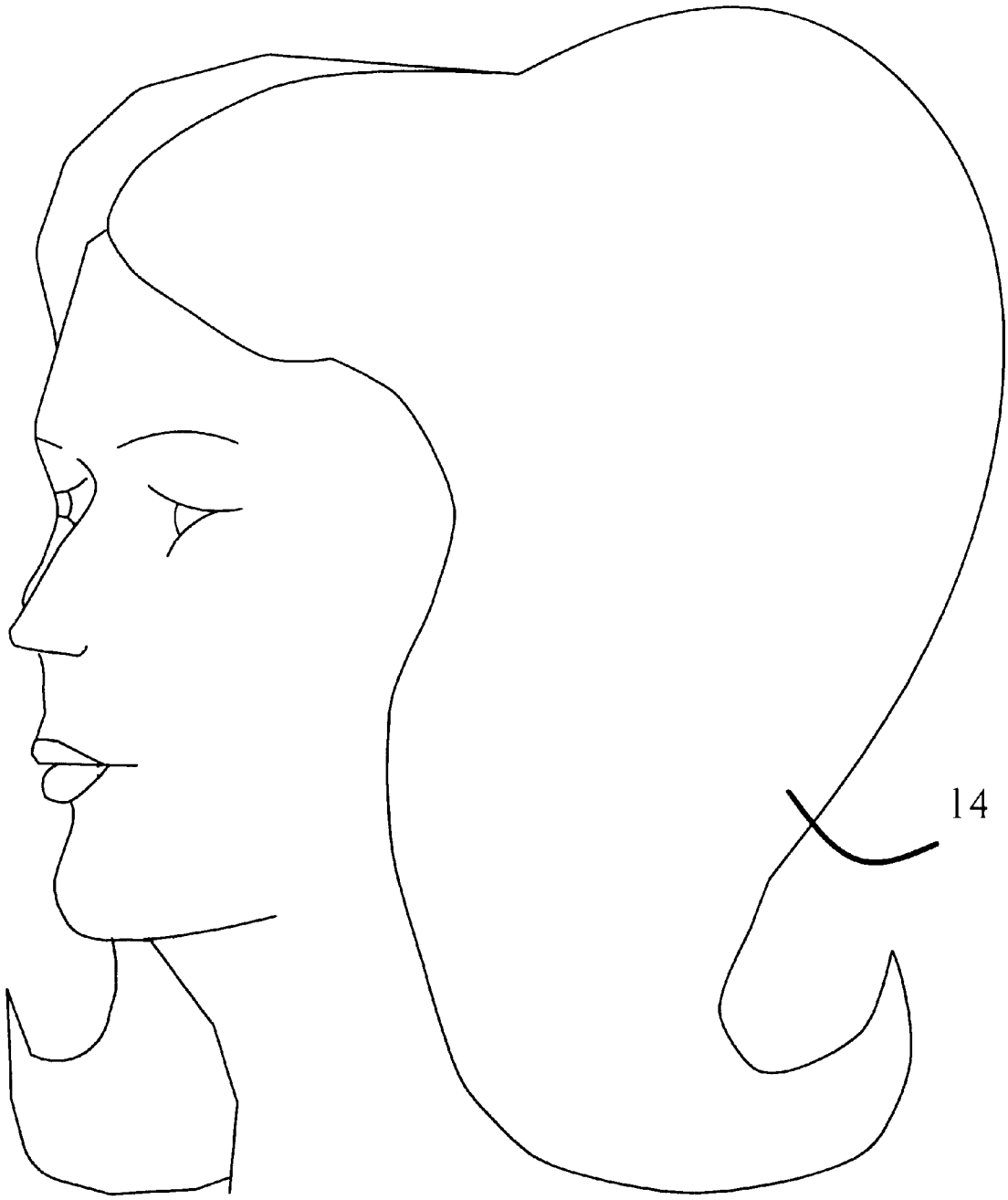
FIG. 2 is a perspective view of the present invention.
Figure 3:
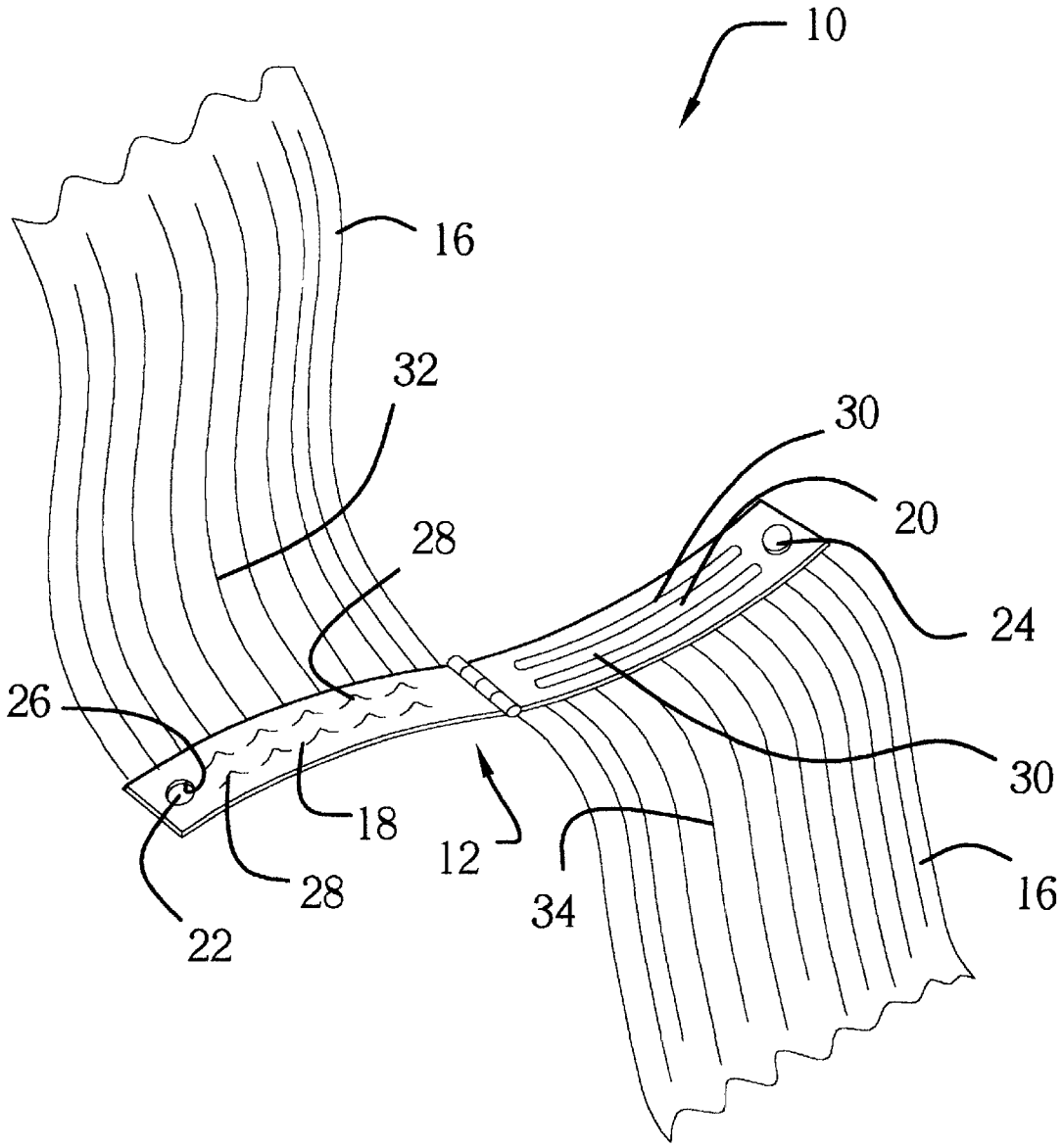
FIG. 3 is a perspective view of the present invention.
Figure 4:
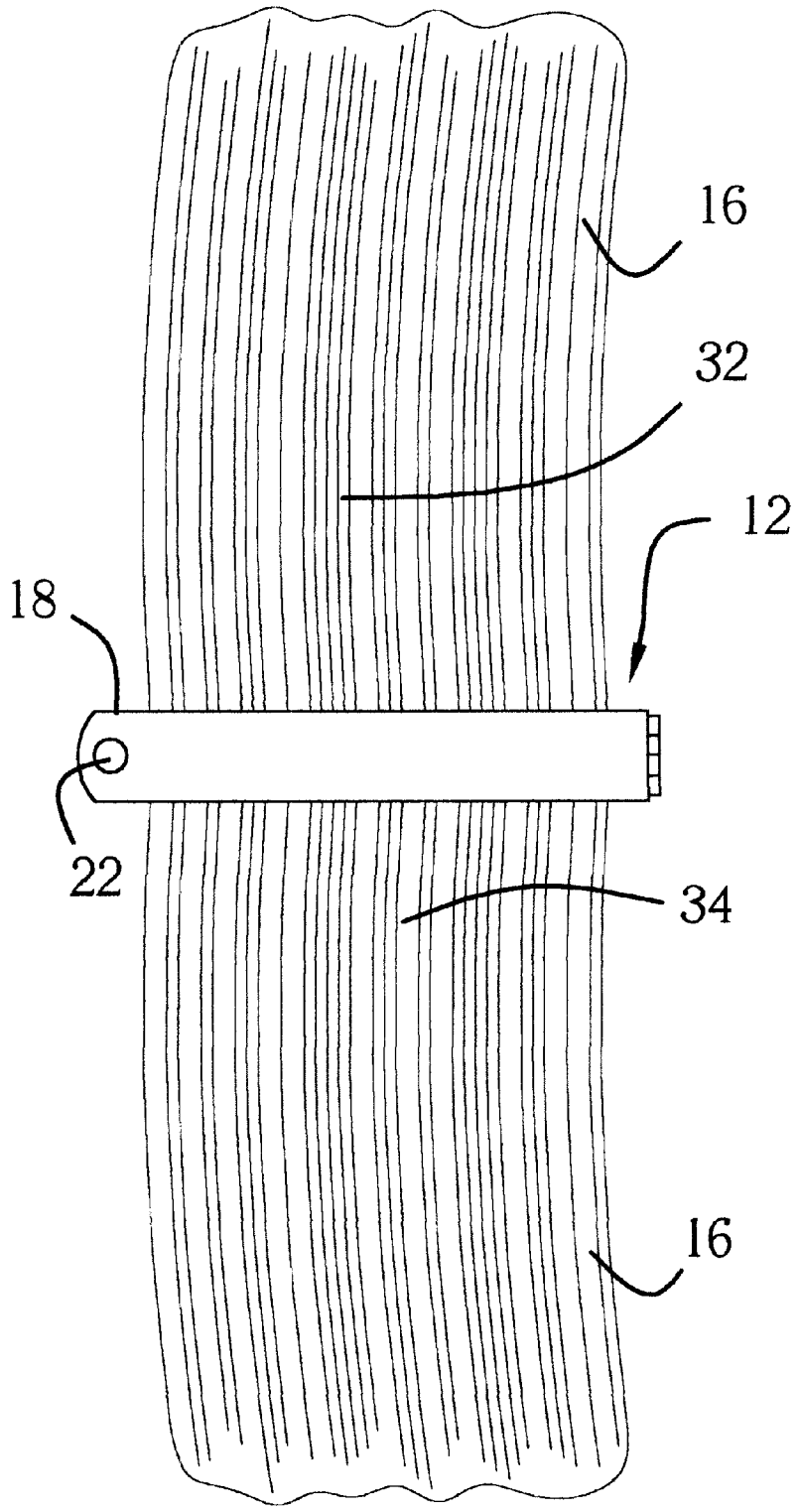
FIG. 4 is a top view of the present invention.

With reference now to the drawings and in particular to FIGS. 1 through 4 thereof, a new hair piece assembly embodying the principles and concepts of the present invention and generally designated by the reference numeral 10 will be described.

As best illustrated in FIGS. 1 through 4, the hair piece assembly 10 generally includes a clip assembly 12 that is designed for securing to the hair 14 of the user such that the clip assembly 12 is secured to the hair 14 of the user. A plurality of filler hairs 16 is coupled the clip assembly 12. The filler hairs 16 are designed for being combed into the hair of the user for providing volume to the hair 14 of the user.

The clip assembly 12 has a first member 18 and a second member 20. The first member 18 is hingably coupled to the second member 20 such that the first member 18 is designed for securing the hair 14 of the user between the first member 18 and the second member 20.

The first member 18 of the clip assembly 12 has a locking aperture 22. The second member 20 of the clip assembly 12 has a locking protrusion 24. The locking protrusion 24 of the second member 20 frictionally engages a perimeter edge 26 of the locking aperture 22 of the first member 18 such that the first member 18 is frictionally coupled to the second member 20 when the first member 18 is positioned adjacent the second member 20 for inhibiting inadvertent release of the hair 14 of the user secured between the first member 18 and the second member 20.

The first member 18 of the clip assembly 12 has a plurality of enraging protrusions 28. The second member 20 of the clip assembly 12 has a plurality of channels 30. Each of the protrusions 28 extends into one of the channels 30 when the first member 18 is positioned adjacent the second member 20. The engaging protrusions 28 are designed to be extended between the hairs 14 of the users such that the protrusions 28 are designed for inhibiting the clip assembly 12 from sliding of the hair 14 of the user.

The filler hairs 16 comprise a first set of filler hairs 32 and second set filler hairs 34. The first set of filler hairs 32 are coupled to the first member 18 of the clip assembly 12. The second set of filler hairs 34 are coupled to the second member 20 of the clip assembly 12 whereby The second set of filler hairs 34 are positioned in an opposite direction from the first set of filler hairs 32. The filler hairs 16 are designed for being dispersed between the hairs 14 of the user for providing volume to the hair 14 of the user.

In use, a user would attach the present invention to original hair with one half pointing upward and the opposite half pointing downward. Once the barrette was in place, the hair would be backcombed to cover the barrette.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A hair piece for adding volume to a user's hair, the hair piece comprising:

a clip assembly being adapted for securing to the hair of the user such that said clip assembly is secured to the hair of the user;

a plurality of filler hairs being coupled said clip assembly, said filler hairs being adapted for being combed into the hair of the user for providing volume to the hair of the user;

said clip assembly having a first member and a second member, said first member being hingably coupled to said second member such that said first member is adapted for securing the hair of the user between said first member and said second member; and said filler hairs comprising a first set of filler hairs and second set filler hairs, said first set of filler hairs being coupled to said first member of said clip assembly, said second set of filler hairs being coupled to said second member of said clip assembly such that said second set of filler hairs are positioned in an opposite direction from said first set of filler hairs, said filler hairs being adapted for being dispersed between the hairs of the user for providing volume to the hair of the user.

2. The hair piece as set forth in claim 1, further comprising:

said first member of said clip assembly having a locking aperture, said second member of said clip assembly having a locking protrusion, said locking protrusion of said second member frictionally engaging a perimeter edge of said locking aperture of said first member such that said first member is frictionally coupled to said second member when said first member is positioned adjacent said second member for inhibiting inadvertent release of the hair of the user secured between said first member and said second member.

3. The hair piece as set forth in claim 1, further comprising:

said first member of said clip assembly having a plurality of engaging protrusions, said second member of said clip assembly having a plurality of channels, each of said protrusions extending into one of said channels when said first member is positioned adjacent said second member, said engaging protrusions being adapted for extending between the hairs of the users such that said protrusions are adapted for inhibiting said clip assembly from sliding of the hair of the user.

4. A hair piece for adding volume to a user's hair, the hair piece comprising:

a clip assembly being adapted for securing to the hair of the user such that said clip assembly is secured to the hair of the user;

a plurality of filler hairs being coupled said clip assembly, said filler hairs, said filler hairs being adapted for being combed into the hair of the user for providing volume to the hair of the user;

said clip assembly having a first member and a second member, said first member being hingably coupled to said second member such that said first member is adapted for securing the hair of the user between said first member and said second member;

said first member of said clip assembly having a locking aperture, said second member of said clip assembly having a locking protrusion, said locking protrusion of said second member frictionally engaging a perimeter edge of said locking aperture of said first member such that said first member is frictionally coupled to said second member when said first member is positioned adjacent said second member for inhibiting inadvertent release of the hair of the user secured between said first member and said second member;

said first member of said clip assembly having a plurality of engaging protrusions, said second member of said clip assembly having a plurality of channels, each of said protrusions extending into one of said channels when said first member is positioned adjacent said second member, said engaging protrusions being adapted for extending between the hairs of the users such that said protrusions are adapted for inhibiting said clip assembly from sliding of the hair of the user; and said filler hairs comprising a first set of filler hairs and second set filler hairs, said first set of filler hairs being coupled to said first member of said clip assembly, said second set of filler hairs being coupled to said second member of said clip assembly such that said second set of filler hairs are positioned in an opposite direction from said first set of filler hairs, said filler hairs being adapted for being dispersed between the hairs of the user for providing volume to the hair of the user.

* * * * *